United States Patent [19]

Bradley

[11] 4,155,266

[45] May 22, 1979

[54] SUPPORT HOUSING FOR ADAPTING AUTOMOBILE STARTER MOTORS TO AIRCRAFT ENGINES

[76] Inventor: James L. Bradley, 177 37th Ave. N., St. Petersburg, Fla. 33704

[21] Appl. No.: 846,385

[22] Filed: Oct. 28, 1977

[51] Int. Cl.[2] ..... F02N 11/14; F02N 15/06

[52] U.S. Cl. ..... 74/6; 74/606 R; 123/179 AS; 123/195 A

[58] Field of Search ..... 74/6, 7 R, 7 A, 606 R; 123/179 AS, 195 A

[56] References Cited

U.S. PATENT DOCUMENTS

| | | | |
|---|---|---|---|
| 1,185,300 | 5/1916 | Foster | 74/6 X |
| 1,307,231 | 6/1919 | Backman | 74/7 |
| 1,330,567 | 2/1920 | Woolson | 74/7 R X |
| 1,905,836 | 4/1933 | Gerald | 74/7 |
| 2,074,110 | 3/1937 | Gruenberger | 74/7 |

*Primary Examiner*—Allan D. Herrmann
*Attorney, Agent, or Firm*—Duckworth, Hobby, Allen & Pettis

[57] ABSTRACT

A support for automotive starter motors of the type having a shaft rotated by the motor, in which the starter motor includes a gear mounted on the shaft for engaging the flywheel of an aircraft engine or the like, in which the support comprises a first plate for mounting adjacent the flywheel and a second plate normal to the first plate, the second plate having a hole therein. The starter motor is bolted to the second plate with the shaft extending through the hole. A conical housing is carried by the second plate and has a hole at the apex thereof, rotatably supporting the extremity of the starter motor shaft, the housing further including an opening along one side thereof for permitting access of the gear to the flywheel.

1 Claim, 5 Drawing Figures

SUPPORT HOUSING FOR ADAPTING AUTOMOBILE STARTER MOTORS TO AIRCRAFT ENGINES

BACKGROUND OF THE INVENTION

1. Field of the Invention

The present invention relates generally to aircraft engines, and in particular, to supports for starter motors for aircraft engines.

2. Description of the Prior Art

Starter motors for automobiles generally include a shaft which is driven by the motor, the shaft extending out of the starter motor housing and having a centrifugal gear mounted on the shaft for engagement with the flywheel of the automobile engine. As a general rule, the main housing of the starter motor is attached by a bracket or similar means to the automobile engine block, with the extremity of the starter motor shaft being supported in a recess in the engine block.

Newly manufactured aircraft engines likewise have a starter motor associated therewith. Certain types of aircraft engines, such as the Lycoming, employ a flywheel which is similar to the flywheel of an automobile engine. The original starter motor equipment adapted for use with newly manufactured flywheel-type engines (such as the Lycoming) are typically mounted in association with the flywheel in a manner similar to that described above with respect to automobile engine manufacture.

Because of the strict engine requirements associated with aircraft engine manufacture, replacement starter motors for such engines are prohibitively expensive for certain types of aircraft engine use where such safety requirements are not as stringent. For example, aircraft engines are used to power airboats, and it is desirable to employ less expensive automobile starter motors as replacement parts for the original aircraft engine starter motor when a replacement is required. However, presently manufactured automobile engine starter motors are not designed for such uses.

The following prior art U.S. Pat. Nos. are of interest: 1,144,438; 1,242,959; 2,974,538; 3,696,689; 3,772,938 and 3,888,226.

SUMMARY OF THE INVENTION

The present invention is directed to a support for automotive starter motors of the type having a shaft rotated by the motor, in which the motor includes gear means on the shaft for engaging the flywheel of an aircraft engine. The support comprises a first plate for mounting adjacent the flywheel, with a second plate normal to the first plate and including a hole therein. Means are provided for holding the starter motor against the second plate with a shaft extending through the hole. A conical bell housing is carried by the second plate and includes a hole at the apex thereof for rotatably supporting the extremity of the starter motor shaft, the housing further including an opening along one side for permitting access of the gear means to the flywheel.

The support of the present invention is used in combination with an aircraft engine of the type having a drive shaft with a circular flywheel rotatably mounted thereon. The first plate is mounted in such a manner that the gear means engages the flywheel in a conventional manner, with the bell housing serving as a means for resisting the shock caused by the backlash frequently encountered when attempting to start a hot, high compression aircraft engine. The housing accomplishes this aspect of the present invention by rigidly supporting the extremity of the starter motor shaft while allowing free rotation thereof.

FIGS. *3a, b* and *c* are front, side and top views, respectively, of a support bracket in accordance with the present invention.

DETAILED DESCRIPTION

The apparatus in accordance with the present invention will now be described with reference to FIGS. 1–3.

Figure 1:
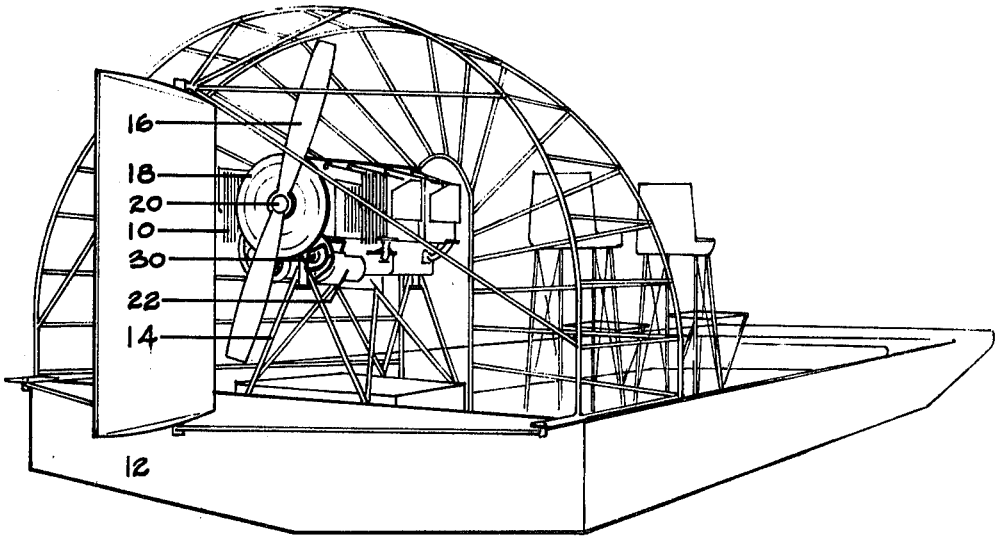
FIG. 1 is a perspective view of an airboat employing an aircraft engine adapted for use with an automotive starter motor in accordance with the present invention.

With specific reference to FIG. 1, the present invention is used in conjunction with an aircraft engine 10 mounted on an airboat 12 of conventional design. Typically, the aircraft engine is mounted by support braces 14 to the rear of the boat 12. The engine 10 drives a propeller 16 to push the airboat across the surface of the water.

The present invention is adapted for use with the engine 10 of the type employing a flywheel 18 mounted on the drive shaft 20 of the engine 10. An automotive starter motor 22 is provided, the starter motor 22 further including a shaft 24 and a centrifugal gear 26 mounted on the shaft for engagement with the flywheel 18. (Note FIGS. 2 and 3). A bushing 28 is mounted on the extremity of the shaft 24.

Figure 2:
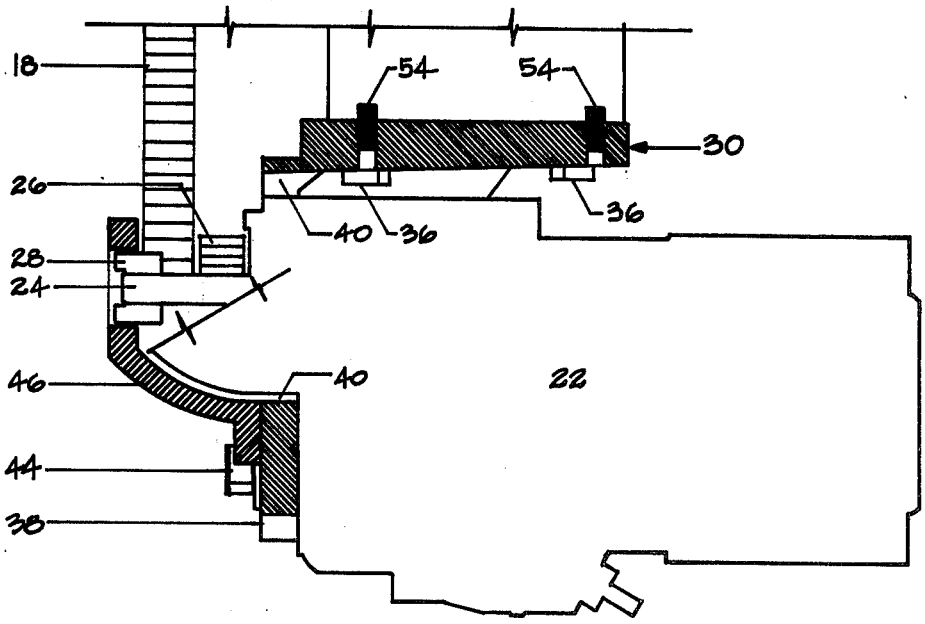
FIG. 2 is a side view, partially in cross section, of apparatus in accordance with the present invention.
Figure 3A:
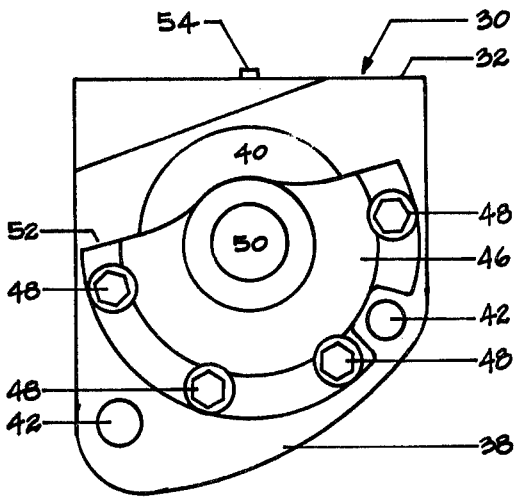
Figure 3B:
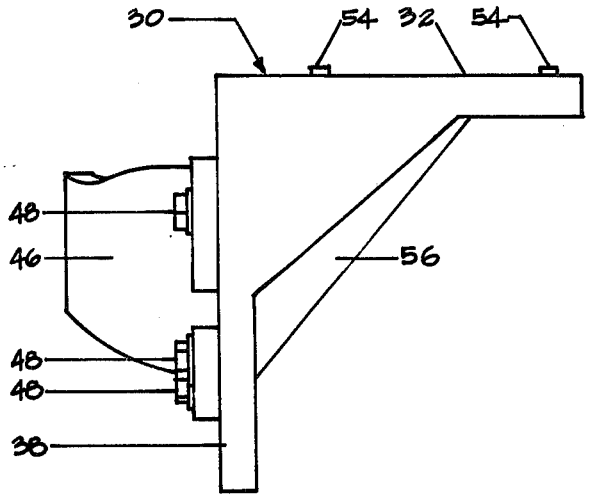
Figure 3C:
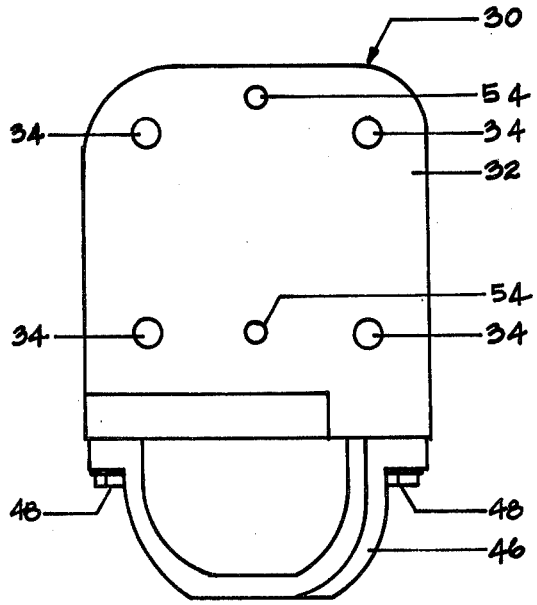

Reference is now made to FIGS. 1, 2 and *3a, c* inclusive. In accordance with the present invention, a support bracket 30 is provided. The support bracket 30 includes a first plate 32 having four mounting holes 34, and corresponding fasteners, such as machine screws 36 for mounting the first plate in abutment with the block of the engine 10 adjacent to the flywheel 18. The first plate 32 includes alignment studs 54 for properly aligning the bracket 30 with respect to the engine block 10 and shaft 20. The bracket 30 further includes a second plate 38 extending normal to the first plate 32, the second plate having a hole 40 therein adapted to receive the starter motor 22 at the base of the shaft 24. The second plate 38 includes mounting holes 42 and associated machine screws 44 for permitting mounting of the starter motor 22 to the second plate.

In accordance with the present invention, the bracket 30 is provided with a conically shaped bell housing 46 carried by the second plate 38 by means of a plurality of machine screws 48. Alternatively, the bell housing 46 may be integrally molded with the second plate 38. The housing 46 includes a hole 50 extending through the apex of the housing, the hole 50 adapted to receive the extremity of the shaft 24 on the starter motor 22, with the bushing 28 supporting the extremity of the shaft 24 in a rotatable manner. As shown in FIGS. *3a, b* and *c*, the bell housing 46 has a portion of the housing removed so as to permit access of the gear 26 to the flywheel 18. This removed portion is defined by the peripheral surface 52 of the housing 50. However, as is shown in FIG. *3a*, the peripheral surface 52 is curved so as to permit the housing 46 to completely surround the hole 50.

The bracket 30 is further provided with support webs 56 between the first and second plates, 32, 38, to provide additional rigidity to the overall structure.

In use, the bracket 30 is mounted to the block of the engine 10 adjacent the flywheel 18, in the manner shown in FIG. 2. Thereafter, the starter motor 22 is operated in a conventional manner so as to permit the centrifugal gear 26 to engage the flywheel 18 to turn the drive shaft 20 of the aircraft engine for starting purposes. As will be more clearly understood with reference to FIG. 2, the housing 46 completely surrounds the extremity of the shaft 24 of the starter motor 22, thus providing sufficient rigidity and support during periods of high back resistance during engagement of the gear 26 to the flywheel 18. Heretofore, attempts to adapt automotive starter motors for use with aircraft engines have failed because the high back resistance of the aircraft engine frequently broke the shaft of the starter motor.

While a specific form of the support of the present invention has been shown and described above, it will be understood by those skilled in the art that various modifications may be employed without departing from the spirit and scope of the present invention.

I claim:

1. In combination:

an aircraft engine of the type having a drive shaft with a circular flywheel rotatably mounted thereon;

a starter motor having a shaft rotated by said motor, said motor further including gear means mounted on said motor shaft for engagement with said flywheel when said starter motor is operational;

a bracket mounted against said aircraft engine for holding said starter motor in an operable position adjacent said flywheel, said bracket including a first plate in abutment with said aircraft engine and a second plate normal to said first plate with a hole extending through said second plate;

said bracket including means for rigidly supporting the extremity of said starter motor shaft, said supporting means including a housing surrounding said starter motor shaft, with said housing further including a hole therein substantially axial with the hole in said second plate, said hole in said housing completely surrounding the extremity of said starter motor shaft with low frictional bearing means between the extremity of said starter motor shaft and said housing, said housing further including an opening along one side thereof facing said flywheel, with said housing carried by said second plate; and brace means including supporting webs coupled to and extending between said first and second plates.

* * * * *